US007586475B2

(12) United States Patent
Lee et al.

(10) Patent No.: US 7,586,475 B2
(45) Date of Patent: Sep. 8, 2009

(54) CIRCUIT FOR DRIVING LIQUID CRYSTAL DISPLAY DEVICE

(75) Inventors: Oh Hyun Lee, Gimcheon-si (KR); Sun Woo Kwag, Seoul (KR); Deuk Woo Lee, Gumi-si (KR)

(73) Assignee: LG. Display Co., Ltd., Seoul (KR)

( * ) Notice: Subject to any disclaimer, the term of this patent is extended or adjusted under 35 U.S.C. 154(b) by 645 days.

(21) Appl. No.: 11/172,600

(22) Filed: Jun. 30, 2005

(65) Prior Publication Data

US 2006/0028419 A1 Feb. 9, 2006

(30) Foreign Application Priority Data

Aug. 9, 2004 (KR) ..... 10-2004-0062404

(51) Int. Cl.
*G09G 3/36* (2006.01)

(52) U.S. Cl. ..... 345/98

(58) Field of Classification Search ..... 345/87, 345/204, 98; 711/103; 365/189.011, 189.16
See application file for complete search history.

(56) References Cited

U.S. PATENT DOCUMENTS 5,371,793 A * 12/1994 Kimura ..... 713/193
2006/0232572 A1* 10/2006 Riemschneider ..... 345/204

FOREIGN PATENT DOCUMENTS

KR 2004/0019220 3/2004
WO WO 03/027949 A1 * 4/2003

OTHER PUBLICATIONS

Office Action dated Jan. 25, 2006 for Korean Patent Application No. 10-2004-0062404.

* cited by examiner

*Primary Examiner*—Amr Awad
*Assistant Examiner*—Stephen G Sherman
(74) *Attorney, Agent, or Firm*—Brinks Hofer Gilson & Lione

(57) ABSTRACT

A circuit that drives a liquid crystal display device, includes an EEPROM having control data that over-drives and provides adaptive brightness intensification, the control data in the EEPROM is protected so as to secure reliability of the EEPROM. The circuit includes a master for over-driving and adaptive brightness intensification, a slave for providing control data to the master, a connector for connecting external writing equipment with terminals on the slave to write the control data into the slave, and an internal power supply of a liquid crystal module that applies an internal supply voltage to the slave. A write control terminal on the slave is grounded in a write mode, and connected to the internal power supply of the liquid crystal module in a liquid crystal module drive mode.

16 Claims, 10 Drawing Sheets

Write mode

CIRCUIT FOR DRIVING LIQUID CRYSTAL DISPLAY DEVICE

This application claims the benefit of Korean Patent Application No. P2004-62404, filed on Aug. 9, 2004, which is hereby incorporated by reference as if fully set forth herein.

BACKGROUND OF THE INVENTION

1. Field of the Invention

The present invention relates to a liquid crystal display device, and more particularly, to a circuit for driving a liquid crystal display device.

2. Discussion of the Related Art

With the progress of information-dependent society, the demand for various display devices has increased. To meet such a demand, efforts have recently been made to research and develop flat panel display devices such as liquid crystal displays (LCDs), plasma display panels (PDPs), electro-luminescent displays (ELDs), vacuum fluorescent displays (VFDs), and the like. Some types of such flat panel display devices are being practically applied to various appliances for display purposes.

In particular, LCDs have been used as a substitute for cathode ray tubes (CRTs) in association with mobile image display devices owing to their characteristics and advantages of superior picture quality, lightness, thinness, and low power consumption. Thus, LCDs are currently most widely used. Various applications of LCDs are being developed in association with not only mobile image display devices such as monitors of notebook computers, but also monitors of TVs to receive and display broadcast signals, and monitors of laptop computers.

Therefore, the successful application of LCDs to diverse image display devices depends on the ability of LCDs to realize desired high picture quality including high resolution, high brightness, large display area, and the like, while maintaining desired characteristics of lightness, thinness, and low power consumption.

Such an LCD mainly includes a liquid crystal panel for displaying an image signal, and a driving circuit for applying a drive signal to the liquid crystal panel.

Although not shown in the drawings, the liquid crystal panel is comprised of two transparent substrates (glass substrates) bonded to each other so as to have a certain space therebetween, and a liquid crystal layer formed between the two transparent substrates.

In one of the two transparent substrates is formed a plurality of gate lines arranged at certain regular intervals, a plurality of data lines arranged perpendicularly to the gate lines for defining pixel areas, a plurality of pixel electrodes formed respectively in the pixel areas, and a plurality of thin film transistors formed respectively at intersections of the gate lines and the data lines and each serving to transfer a data signal on an associated one of the data lines to an associated one of the pixel electrodes in response to a gate signal on an associated one of the gate lines.

As a result, whenever a turn-on signal is sequentially applied to the gate lines, a data signal is applied to a pixel electrode of the corresponding gate line so as to display an image.

Here, the image displayed on the liquid crystal panel is composed of one frame when it is a still image, and a plurality of frames when it is a moving image in which a plurality of sequential still images are successively expressed.

In the case where the displayed image is a moving image, the liquid crystal varies successively with the magnitudes of data signals corresponding respectively to frames of the moving image.

That is, in order to express one moving image with five frames on the liquid crystal panel, the liquid crystal varies successively with the magnitudes of data signals corresponding respectively to the five frames because the magnitudes of the data signals are different.

The magnitude of the data signal of each frame is expressed on the liquid crystal layer as the level of a gray-scale voltage so as to vary the orientation of liquid crystal molecules of the liquid crystal layer. Because the liquid crystal molecules have dielectric anisotropy, permittivity thereof varies if the longer-axis direction thereof varies. Subsequently, the level of a gray scale voltage to the liquid crystal layer varies with the permittivity of the liquid crystal molecules of the liquid crystal layer, resulting in a significant reduction in response speed of the liquid crystal molecules.

Namely, in the case where the gray scale voltage to the liquid crystal is to be changed from a low level to high level (or vice versa), it can reach the desired level, not at once, but after the lapse of several frames from a current frame, because the gray scale voltage of a data signal of the current frame is influenced by the gray scale voltage of a data signal of a previous frame.

For example, in order to express one moving image composed of two successive frames, the liquid crystal must be changed to the level of a gray scale voltage corresponding to an image of the second frame at once after being maintained in a state changed to the level of a gray scale voltage corresponding to an image of the first frame. However, provided that the response speed of the liquid crystal molecules is reduced due to factors as mentioned above, the liquid crystal will be unable to express the level of the gray scale voltage corresponding to the image of the second frame within a period of one frame.

This phenomenon can be represented as the display of a vague latent image of the first frame of the previous period overlapping with the image of the second frame on the liquid crystal panel.

Accordingly, research has been conducted into a method for improving the response speed of the liquid crystal molecules by over-driving the magnitude of a gray scale voltage setting data signal to a value higher than the normal value.

A conventional liquid crystal display device with an over-driving circuit will hereinafter be described with reference to the annexed drawings.

FIG. 1 is a block diagram showing the configuration of a conventional liquid crystal display device with an over-driving circuit.

The conventional liquid crystal display device comprises, as shown in FIG. 1, a liquid crystal panel 11 having a plurality of gate lines G and a plurality of data lines D arranged perpendicularly to each other for defining pixel areas in the form of a matrix, and a driving circuit 12 for supplying a drive signal and a data signal to the liquid crystal panel 11.

The driving circuit 12 includes an external storage unit 25 for storing a look-up table (LUT) for over-driving, and a direct current-direct current (DC-DC) converter 24 for receiving a voltage from a system through a connector 22, stepping up or down the received voltage, outputting the resulting drive voltages Vcc and Vdd necessary to respective components, and outputting a gate low voltage signal $V_{GL}$ and a gate high voltage signal $V_{GH}$ in response to an enable signal from a timing controller 23. The timing controller 23 is adapted to, upon power-on, read the LUT from the external storage unit (for example, an electrically erasable programmable read only memory (EEPROM)) 25, store the read LUT in an over-driving circuit (ODC) 31 provided therein, correct a video signal inputted from the system into a video signal Do for over-driving on the basis of the LUT, output the corrected video signal Do, and output the enable signal to the DC-DC converter 24. The driving circuit further includes a gate driver 11*a* for generating a scan pulse in response to the gate high voltage signal $V_{GH}$ and gate low voltage signal $V_{GL}$, outputted from the DC-DC converter 24 in response to the enable signal from the timing controller 23, and supplying the generated scan pulse sequentially to the gate lines G of the liquid crystal panel 11, and a data driver 11*b* for receiving the corrected video signal Do outputted from the timing controller 23, digital/analog-converting the received video signal into a corrected analog data signal and supplying the corrected data signal to each of the data lines D of the liquid crystal panel 11.

The timing controller 23 further includes a power control generating logic block 32 for receiving the drive voltage and outputting the enable signal, and a protocol block 33 for providing an Inter IC bus ("I2C") communication protocol when the timing controller 23 communicates with the external storage unit 25 in an I2C protocol manner to read a checksum of data of the look-up table stored in the external storage unit 25.

Two active wires SCL(Clock) and SDA(Data) for the aforementioned communication are connected between the protocol block 33 and the external storage unit 25.

An R, G, B video signal outputted from the system is inputted to the timing controller 23 through the connector 22 sequentially on a frame-by-frame basis. The ODC 31 compares a video signal of a current frame with a video signal of a previous frame on the basis of the look-up table and outputs a corrected video signal Do of a magnitude higher than that of the current frame video signal as a result of the comparison.

That is, in the look-up table, values corresponding to the video signal of the previous frame and the video signal of the current frame are arranged in an x-axis and a y-axis. Also, a value corresponding to the corrected video signal Do is defined at an intersection of the x-axis and y-axis. As a result, the timing controller 23 reads a value at a crossing point of the value of the inputted video signal of the previous frame and the value of the inputted video signal of the current frame from the look-up table and outputs the corrected video signal Do based on the read value.

Therefore, a pixel electrode which receives a corrected data signal, outputted from the data driver 11*b* on the basis of the corrected video signal Do, over-drives the liquid crystal with a higher gray scale voltage.

A more detailed description will hereinafter be given of the over-driving circuit 31 in the timing controller 23.

FIG. 2 is a block diagram of the over-driving circuit in the conventional liquid crystal display device.

An R, G, B video signal outputted from the system is inputted to the timing controller (see 23 in FIG. 1) through the connector (see 22 in FIG. 1) sequentially on a frame-by-frame basis.

The over-driving circuit of the conventional liquid crystal display device includes, as shown in FIG. 2, an internal storage unit (for example, a static random access memory (SRAM)) 31 for storing the look-up table (LUT) stored in the external storage unit 25, first and second frame memories 33*a* and 33*b* for alternately storing the R, G, B video data sequentially inputted from the system on a frame-by-frame basis, and an FFD circuit 33*c* for receiving video data of a current frame inputted from the system and video data of a previous frame stored in the first or second frame memory 33*a* or 33*b*, comparing the received video data of the two frames with each other and outputting a corrected video signal Do of the current frame video data according to the look-up table stored in the internal storage unit 31 as a result of the comparison.

The first and second frame memories 33*a* and 33*b* are adapted to alternately store data of one frame in a write mode and output the stored frame data in a read mode. That is, currently inputted R, G, B video data is stored in the first frame memory 33*a* and video data of a previous frame stored in the second frame memory 33*b* is read. Next, currently inputted R, G, B video data is stored in the second frame memory 33*b* and video data of a previous frame stored in the first frame memory 33*a* is read. This operation is repeated.

An over-driving operation of the conventional over-driving circuit with the above-stated configuration will hereinafter be described.

First, the manufacturer or user creates and stores the look-up table in the external storage unit 25. That is, the look-up table is created by arranging values corresponding to a video signal of a previous frame and a video signal of a current frame in an x-axis and a y-axis, and inputting a value corresponding to a corrected video signal Do at an intersection of the x-axis and y-axis.

The look-up table is created in this manner and is then stored in the external storage unit 25.

Under this condition, whenever power is turned on, the timing controller 23 reads the look-up table stored in the external storage unit 25 and stores it in the ODC 31.

At the time that R, G, B data is inputted from the system, the timing controller 23 stores the inputted R, G, B data in the first frame memory 33*a* and reads data of a previous frame stored in the second frame memory 33*b*. Next, the timing controller 23 stores currently inputted R, G, B data in the second frame memory 33*b* and reads data of a previous frame stored in the first frame memory 33*a*.

Then, the FFD circuit 33*c* retrieves a value at a crossing point of the value of the video signal of the previous frame and the value of the video signal of the current frame from the look-up table and outputs a corrected video signal Do based on the retrieved value. Then, the data driver 11*b* applies the corrected video signal Do to each pixel electrode so as to over-drive the liquid crystal with a higher gray scale voltage.

On the other hand, a backlight unit is placed on the back of a liquid crystal panel of a transmissive liquid crystal display device or along the edge thereof to provide constant light for display under no influence of external light. Such backlight units may be roughly classified into an edge-type backlight unit wherein lamps are disposed along the edge of the liquid crystal panel to supply light to the panel, and a direct-backing type backlight unit wherein lamps are disposed directly on the back of the liquid crystal panel to supply light to the panel.

Recently, the liquid crystal display device has been requested to provide higher-brightness and higher-definition images. In order to meet such a request, high-brightness lamps are provided in the backlight unit. In addition, the lamps are supplied with high lamp current to emit high-brightness light. However, the magnitude of the lamp current to the lamps is in inverse proportion to the service life of the lamps. That is, if the lamp current is raised to obtain high brightness, the service life of the lamps is disadvantageously shortened. Conversely, if the lamp current is reduced to lengthen the service life of the lamps, the brightness of the lamps is disadvantageously lowered. Moreover, the higher the lamp current to the lamps, the larger the power consumption of the liquid crystal display device.

Accordingly, an adaptive brightness intensification backlight unit has been developed in order to solve the above problem. This adaptive brightness intensification backlight unit is characterized in that the luminance of video data is analyzed, a brightness control signal is generated according to the analyzed luminance, and the lamps are driven by an inverter in response to the generated brightness control signal. That is, the brightness of the lamps is controlled according to the gray scale of the video data, thereby lengthening the service life of the lamps and preventing unnecessary power consumption required to drive the lamps to generate the same brightness as that of a high gray scale image with respect to a low gray scale image.

Next, a description will be given of a conventional liquid crystal display device with an adaptive brightness intensification backlight unit with reference to the annexed drawings.

FIG. 3 is a block diagram showing the configuration of a conventional liquid crystal display device with an adaptive brightness intensification backlight unit.

As shown in FIG. 3, a driving circuit 12 includes an external storage unit 25*a* for storing data stretching values and backlight dimming control values for adaptive brightness intensification, and a DC-DC converter 24 for receiving a voltage from a system through a connector 22, stepping up or down the received voltage, outputting the resulting drive voltages Vcc and Vdd necessary to respective components, and outputting a gate low voltage signal $V_{GL}$ and a gate high voltage signal $V_{GH}$ in response to an enable signal from a timing controller 23. The timing controller 23 is adapted to, upon power-on, read data stored in the external storage unit (for example, an EEPROM) 25*a* and allow an adaptive brightness intensifier (AI) circuit 31*a* therein to analyze an inputted image and perform a data stretching function and a backlight dimming control function on the basis of the read data as a result of the image analysis to lower backlight brightness. The timing controller 23 is also adapted to receive a video signal from the system and output a control signal to drive a liquid crystal panel 11 of the liquid crystal display device. The driving circuit 12 further includes a gate driver 11*a* for generating a scan pulse in response to the gate high voltage signal $V_{GH}$ and gate low voltage signal $V_{GL}$, outputted from the DC-DC converter 24 in response to the enable signal from the timing controller 23, and supplying the generated scan pulse sequentially to gate lines G of the liquid crystal panel 11, and a data driver 11*b* for receiving a video signal outputted from the timing controller 23, digital/analog-converting the received video signal into an analog video signal and supplying the converted analog video signal to each data line D of the liquid crystal panel 11. The driving circuit 12 further includes an inverter 34 for driving a backlight lamp 35 in response to a control signal from the AI circuit 31*a*. The remaining parts of the driving circuit 12 are the same as those illustrated in FIG. 1.

The AI circuit 31*a* analyzes the luminance of the inputted video data. The video data is usually inputted in the form of an RGB signal containing red, green and blue image information. This video data is composed of a YUV signal including a luminance signal Y and a chrominance signal (U,V), and the AI circuit 31*a* detects the luminance signal from the YUV signal. Then, the AI circuit 31*a* measures a luminance variation for every frame and outputs the resulting control signal to the inverter 34 to adjust the brightness of the backlight lamp 35.

Here, for the convenience of description of communication between the external storage unit 25*a* and the AI circuit 31*a*, the external storage unit 25*a* is expressed as a slave and the AI circuit 31*a* is expressed as a master.

A look-up table (LUT), the backlight dimming control values and the data stretching values are prestored in the external storage unit 25*a*, which is the slave as aforementioned. When the liquid crystal display device is powered on, the DC-DC converter 24 generates and supplies various voltages for the driving of the display device. In particular, the DC-DC converter 24 supplies a drive voltage Vcc for data communication between the external storage unit 25*a* and the AI circuit 31*a*.

At this time, the drive voltage Vcc from the DC-DC converter 24 is directly supplied to the external storage unit 25*a*.

FIG. 4 is a circuit diagram of an external storage unit of a conventional over-driving circuit or adaptive brightness intensification backlight unit.

In FIG. 4, the external storage unit 25 or 25*a* of the conventional over-driving circuit (ODC) or adaptive brightness intensifier (AI) circuit may be, for example, an electrically erasable programmable read only memory (EEPROM). A desired look-up table is created and written in the EEPROM by a microcomputer so as to be used for over-driving or adaptive brightness intensification.

The look-up table is created in the following manner.

That is, the look-up table is created by arranging values corresponding to a video signal of a previous frame and a video signal of a current frame inputted from the system through the connector 22 in an x-axis and a y-axis, and inputting a value corresponding to a corrected video signal Do at an intersection of the x-axis and y-axis.

The conventional external storage unit, or EEPROM, 25 or 25*a* has a plurality of terminals (first to eighth terminals).

The EEPROM is connected to an external microcomputer in a write mode and to the driving circuit of the liquid crystal display device in a liquid crystal module drive mode.

The first to third terminals 1, 2 and 3 are no connection (NC) terminals which are spare terminals applied with no specific data or voltage. These first to third terminals 1, 2 and 3 are connected to a ground voltage VSS along with the fourth terminal 4, which is a ground voltage terminal. In general, the first to third terminals 1, 2 and 3 can replace other terminals to which a power supply voltage or a data or clock signal is applied, when they fail. The first to third terminals 1, 2 and 3 are grounded regardless of the write mode and the liquid crystal module drive mode before replacing other terminals.

The fifth terminal 5 and the sixth terminal 6 receive a data signal SDA and a clock signal SCL from the microcomputer in the write mode, respectively, and receive a supply voltage VCC from an internal supply voltage generator 32 of the liquid crystal display device in the liquid crystal module drive mode.

The seventh terminal 7 is a write control (WC) terminal to which the ground voltage VSS is applied so that the EEPROM 25 or 25*a* is in a write enable state. This seventh terminal 7 is always applied with the ground voltage VSS regardless of the write mode and the liquid crystal module drive mode.

The eighth terminal 8 is connected to a supply voltage terminal VCC of a connector 40 in the write mode and to the supply voltage VCC in the liquid crystal module drive mode to maintain the EEPROM 25 or 25*a* in the enable state.

The above-mentioned conventional external storage unit, or EEPROM, 25 or 25*a* is always maintained in the write enable state because the write control terminal, or seventh terminal 7, is grounded. For this reason, there is a risk that undesired data may be written in the EEPROM or data written in the EEPROM may be lost, due to external factors of a liquid crystal module (LCM), even in the liquid crystal module drive mode after the write mode is performed.

FIGS. 5A and 5B are photographs showing image quality deteriorations which appear on the screen when a malfunction occurs in the write control terminal of the external storage unit.

FIGS. 5A and 5B show poor display states resulting from the fact that undesired data is written into the EEPROM as the EEPROM is maintained in the enable state due to the grounding of the write control terminal of the EEPROM.

In particular, this problem occurs when the over-driving or adaptive brightness intensification is carried out on the basis of a look-up table containing the undesired data written in the EEPROM.

In other words, the above-described conventional liquid crystal display device has disadvantages as follows.

The EEPROM, which is the external storage unit, is always maintained in the write enable state because the write control terminal is always grounded. For this reason, there is a risk that undesired data may be written in the EEPROM due to external factors when the liquid crystal module is driven.

It is thus difficult to secure reliability of the EEPROM.

In addition, a poor display state may occur when the over-driving or adaptive brightness intensification is carried out on the basis of a look-up table containing the undesired data written in the EEPROM. Therefore a need exists to secure the reliability of the EEPROM.

SUMMARY OF THE INVENTION

A circuit for driving a liquid crystal display device having a write mode and a liquid crystal module drive mode includes a master that over-drives and provides adaptive brightness intensification, a slave that provides desired control data to the master, a writing circuit that controls writing of control data to the slave; a connector that connects the writing circuit with a plurality of terminals of the slave that write the control data into the slave. The circuit for driving the liquid crystal display also includes an internal power supply of a liquid crystal module that applies an internal supply voltage to the slave during the liquid crystal module drive mode, where the write mode does not occur during the liquid crystal module drive mode.

A circuit for driving a liquid crystal display device that has a write mode and a liquid crystal module drive mode includes a master for over-driving a liquid crystal module and provides adaptive brightness intensification and a slave for providing desired control data to the master. A connector is included for connecting external writing equipment with a plurality of terminals of the slave to write the control data into the slave; and an internal power supply of a liquid crystal module for applying an internal supply voltage to the slave, wherein the plurality of terminals of the slave include a write control terminal which is at or about a ground potential in a write mode, and at or about the potential of the internal power supply of the liquid crystal module in a liquid crystal module drive mode.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings. It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the examples of which are illustrated in the accompanying drawings. Wherever possible, the same reference numbers will be used throughout the drawings to refer to the same or like parts.

Figure 6:
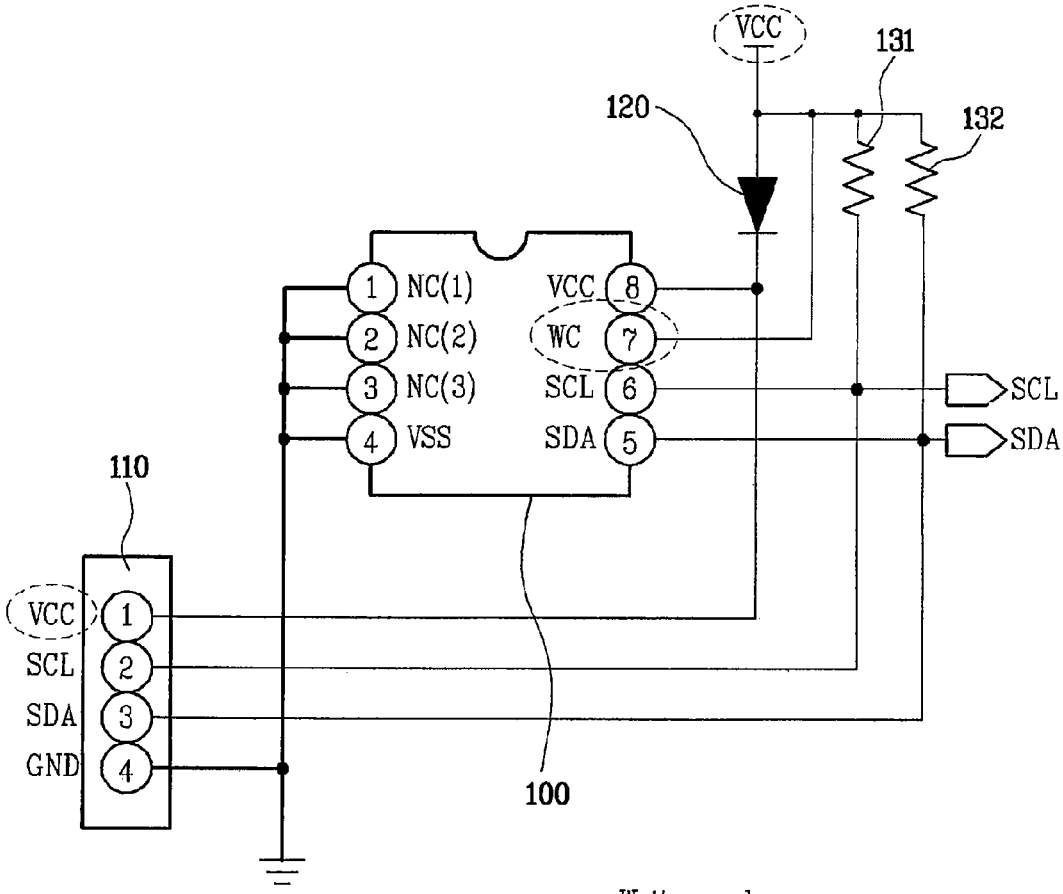
FIG. 6 is a circuit diagram of an external storage unit and peripheral elements of an over-driving circuit or adaptive brightness intensification backlight unit where WC is directly to VCC.
Figure 6:
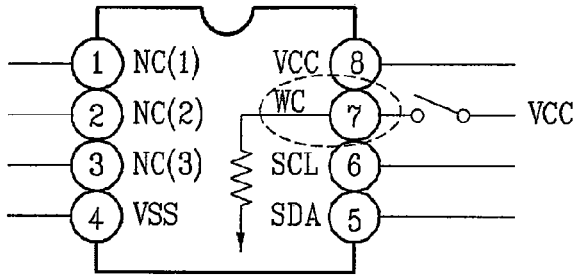

FIG. 6 is a circuit diagram of an external storage unit, or EEPROM, and peripheral elements of an over-driving circuit or adaptive brightness intensification backlight unit.

A driving circuit of a liquid crystal display device may include a gate driver and source driver for applying signals to gate lines and data lines of a liquid crystal panel, and a timing controller (not shown) for applying control signals to the drivers.

Figure 1:
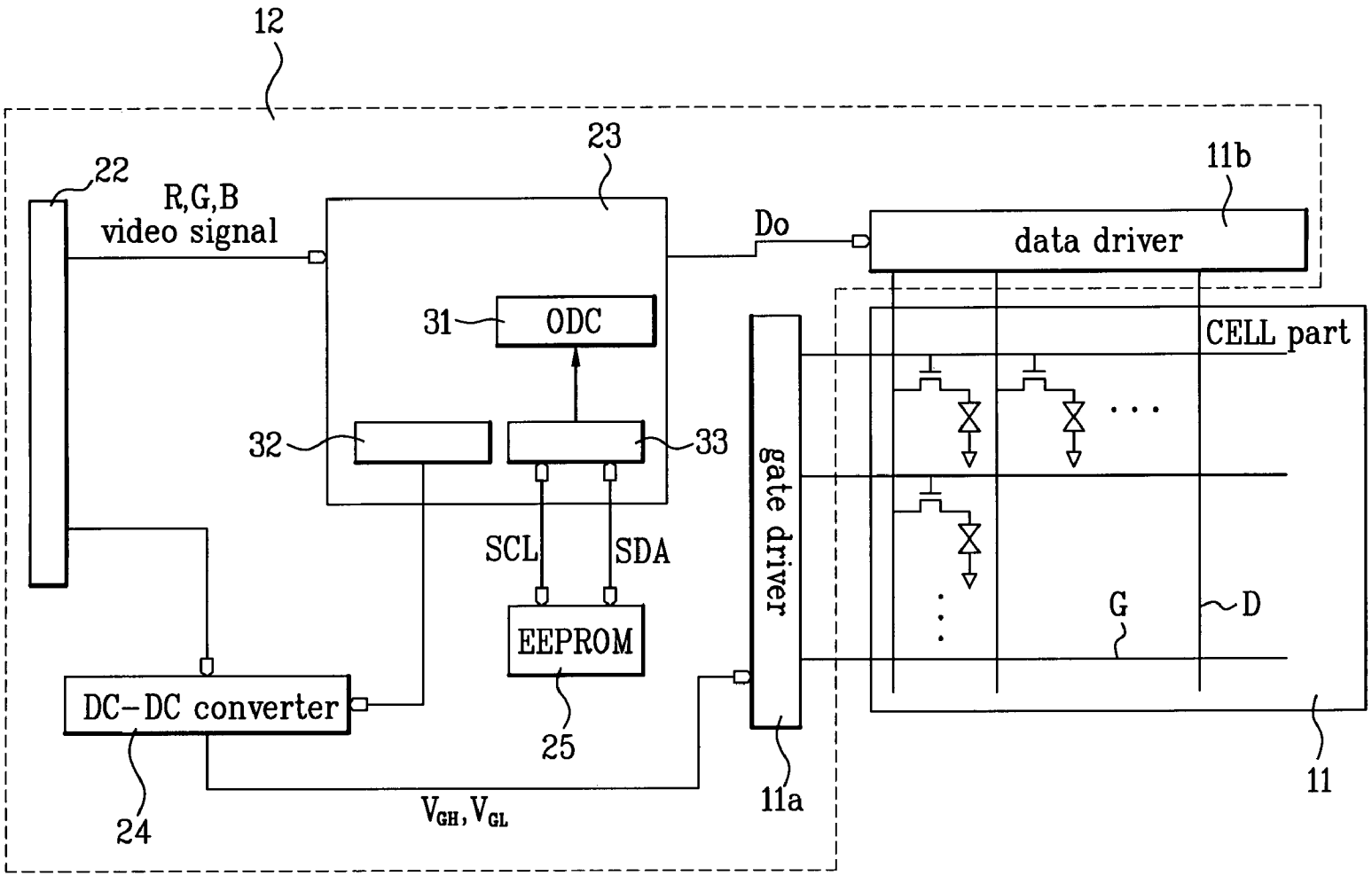
FIG. 1 Prior Art
FIG. 1 is a block diagram showing a configuration of a conventional liquid crystal display device with an over-driving circuit.
Figure 2:
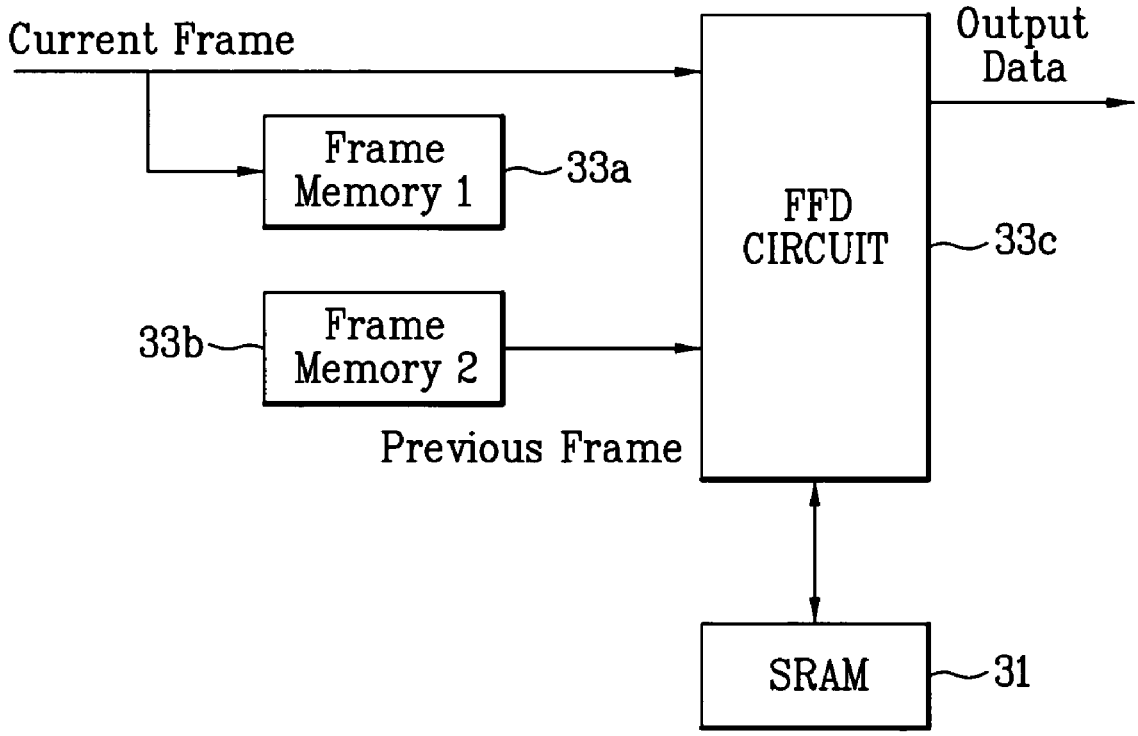
FIG. 2 Prior Art
FIG. 2 is a block diagram of an over-driving circuit.
Figure 3:
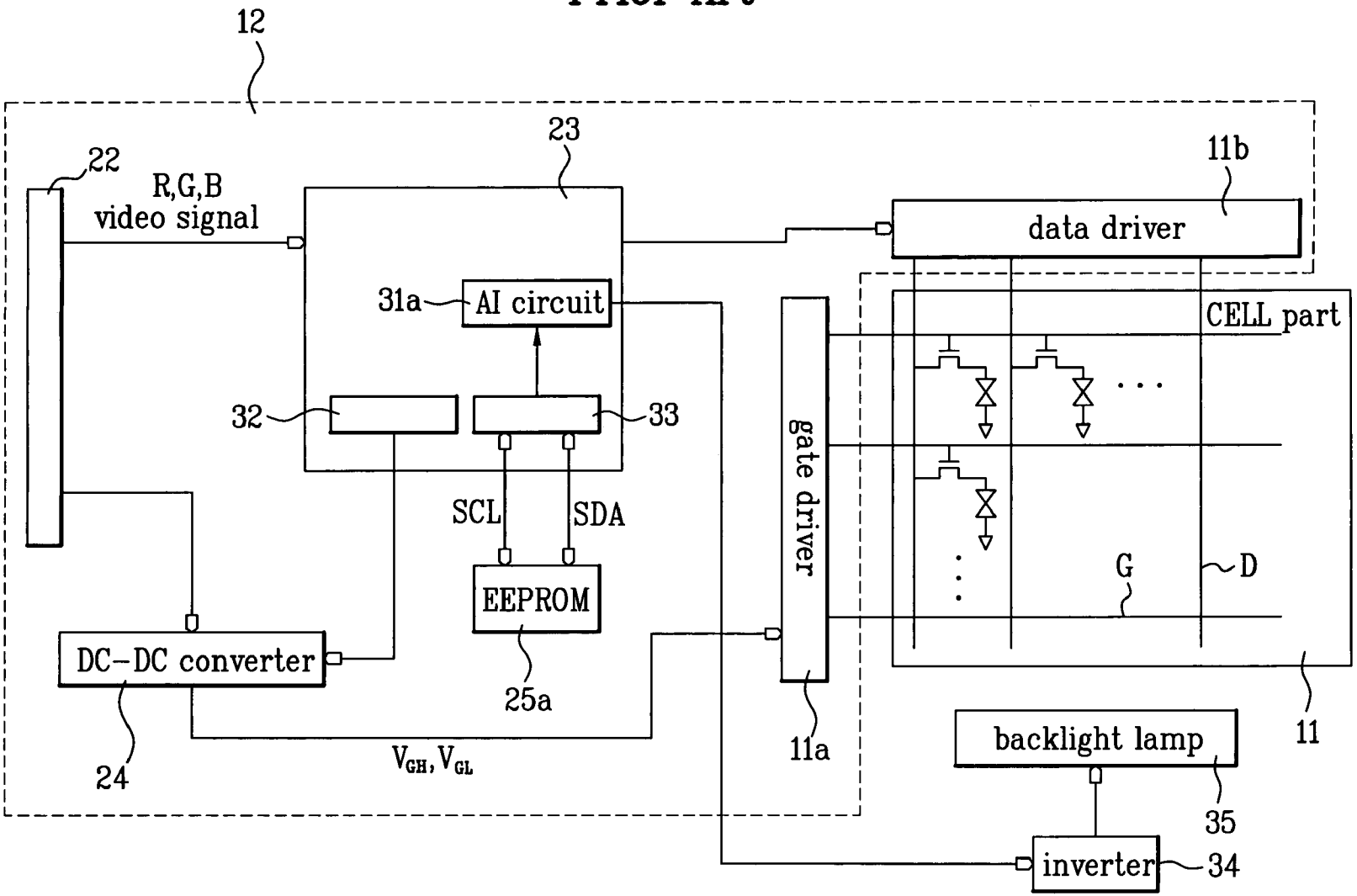
FIG. 3 Prior Art
FIG. 3 is a block diagram of a configuration of a conventional liquid crystal display device with an adaptive brightness intensification backlight unit.
Figure 4:
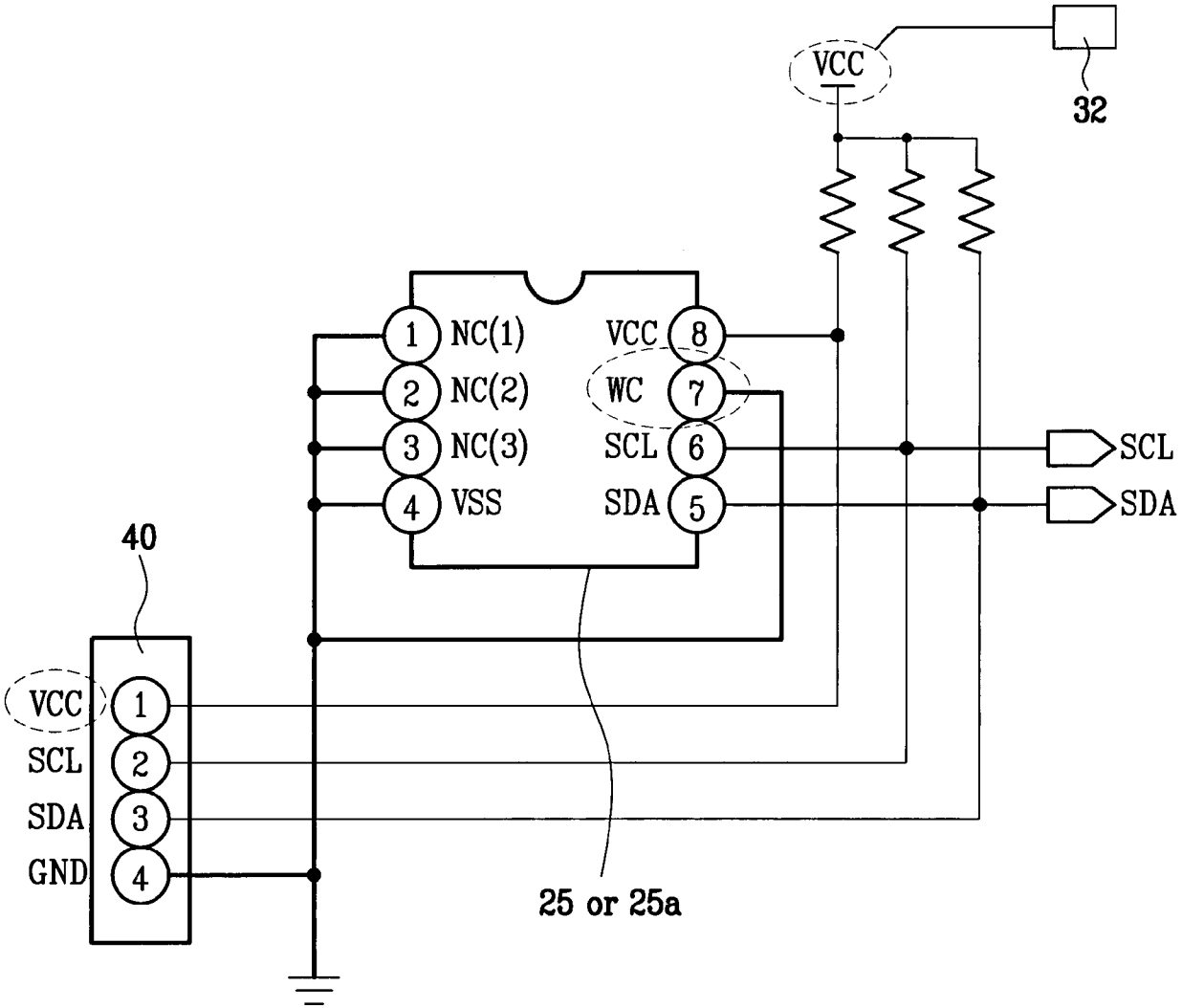
FIG. 4 Prior Art
FIG. 4 is a circuit diagram of an external storage unit.
Figure 5A:
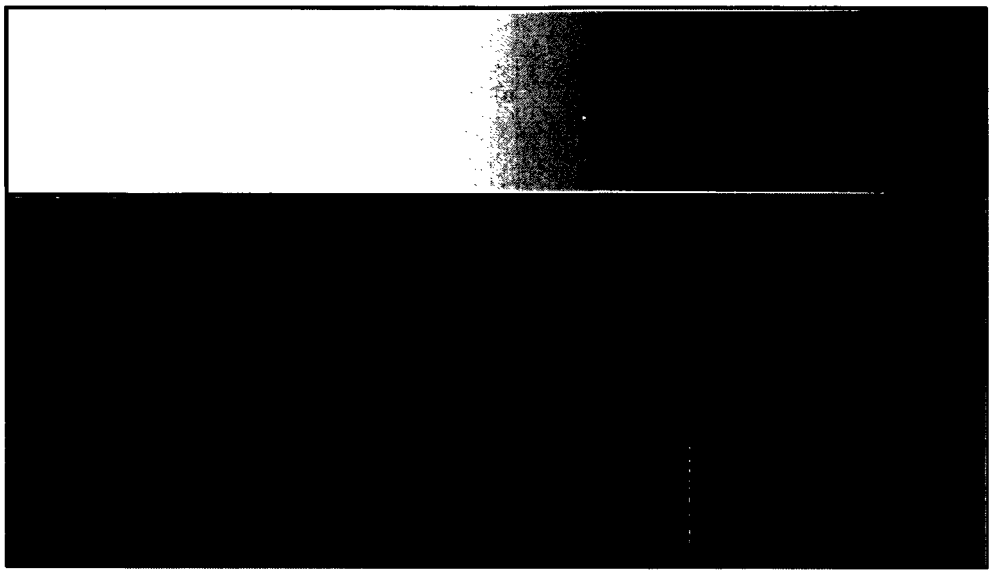
FIG. 5A Prior Art
FIGS. 5A and 5B are photographs of image quality deteriorations appearing on a screen.
Figure 5B:
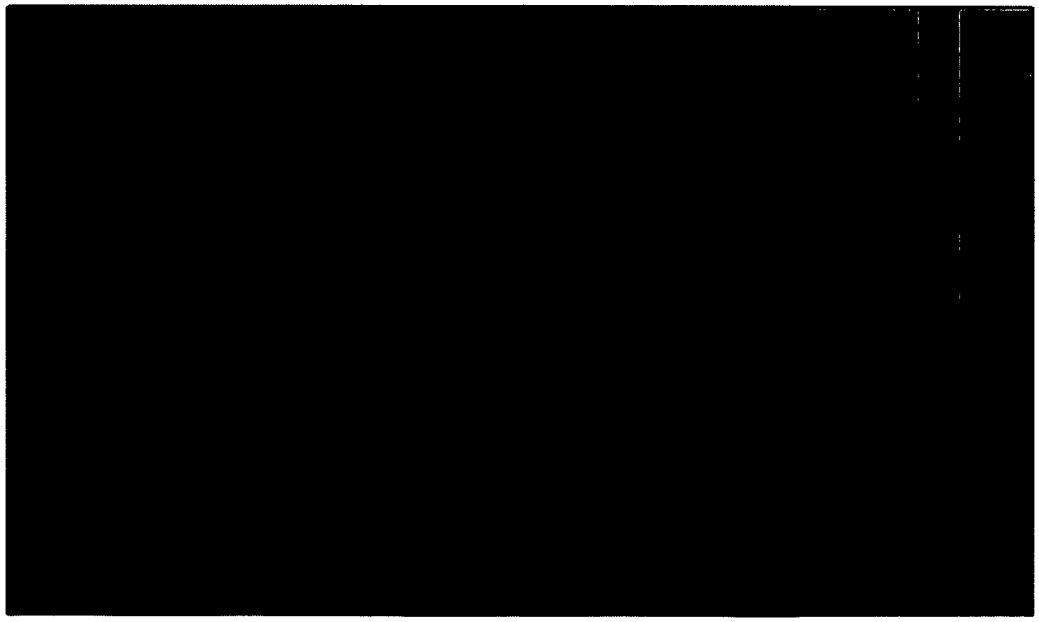
FIG. 5B Prior Art

The driving circuit may include a master (not shown) (see the internal block of the timing controller in FIGS. 1 and 3) for controlling the over-driving and adaptive brightness intensification.

As shown in FIG. 6, the driving circuit of the liquid crystal display device also may include an external storage unit, or EEPROM, 100 for providing control data (look-up table (LUT)) necessary to the control of the over-driving or adaptive brightness intensification by the timing controller, and a connector 110 for connecting external ROM writing equipment (not shown) with a plurality of terminals of the EEPROM 100 to write the control data into the EEPROM 100. Among the terminals of the EEPROM 100, the fifth terminal and the sixth terminal receive a data signal SDA and a clock signal SCL, respectively. The driving circuit further includes an internal power supply VCC of a liquid crystal module for applying an internal supply voltage VCC to the EEPROM 100. Among the terminals of the EEPROM 100, the seventh terminal is a write control terminal which is grounded in a write mode and connected to the internal power supply VCC of the liquid crystal module in a liquid crystal module drive mode. A diode 120 is connected between the internal power supply VCC of the liquid crystal module and the eighth terminal of the EEPROM 100, which is a supply voltage terminal. A first resistor 131 is connected between the internal power supply VCC of the liquid crystal module and the SCL terminal (sixth terminal) of the EEPROM 100, and a second resistor 132 is connected between the internal power supply VCC of the liquid crystal module and the SDA terminal (fifth terminal) of the EEPROM 100.

The connection between the connector 110 and the EEPROM 100 may be made in the following manner. The first terminal (supply voltage terminal) of the connector 110 is connected with the eighth terminal of the EEPROM 100, which receives the supply voltage from the internal power supply VCC of the liquid crystal module via the diode 120. Namely, the eighth terminal of the EEPROM 100 is connected with the cathode of the diode 120 and the first terminal of the connector 110 is connected to a connection point of the eighth terminal of the EEPROM 100 and the cathode of the diode 120. Therefore, by virtue of the diode 120, the stable internal supply voltage VCC is applied to the eighth terminal of the EEPROM 100 and the first terminal of the connector 110.

The second terminal of the connector 110 is connected with an SCL terminal of the external ROM writing equipment, and the third terminal of the connector 110 is connected with an SDA terminal of the external ROM writing equipment.

The fourth terminal of the connector 110 is a ground terminal which is grounded. This fourth terminal of the connector 110 is grounded together with the first to third terminals of the EEPROM 100, which are spare terminals, and the fourth terminal of the EEPROM 100, which is a ground terminal.

The operation of the EEPROM 100 in the driving circuit of the liquid crystal display device will hereinafter be described under the condition that it is classified into an operation in the write mode and an operation in the liquid crystal module drive mode.

In the write mode, the second terminal of the connector 110 is connected with the SCL terminal of the external ROM writing equipment, and the third terminal of the connector 110 is connected with the SDA terminal of the external ROM writing equipment.

The second and third terminals of the connector 110 are also connected with the sixth and fifth terminals of the EEPROM 100. As a result, the external ROM writing equipment can communicate with the EEPROM 100 in an Inter-IC ("I2C") communication bus protocol to write desired data into the EEPROM 100.

The seventh terminal of the EEPROM 100, which is the write control (WC) terminal, is opened and internally pulled down to ground in the EEPROM 100 in the write mode so that the EEPROM 100 can be maintained in the write enable state.

On the other hand, in the liquid crystal module drive mode, the EEPROM 100 functions as a memory containing a look-up table for the over-driving or adaptive brightness intensification. In this case, the write control terminal, or the seventh terminal of the EEPROM 100, is directly connected with the internal power supply VCC of the liquid crystal module so as to be applied with a high signal therefrom. As a result, data (look-up table data) stored in the EEPROM 100 in the write mode can be stably protected.

Here, the write control terminal represents a write enable state when being applied with a low signal (ground voltage), and a write protecting state when being applied with a high signal (supply voltage).

In the driving circuit of the liquid crystal display device, as stated above, the supply voltage is applied to the write control terminal of the EEPROM in the liquid crystal module drive mode after the write mode is performed. Therefore, the writing of further different data can be prevented so that the data written in the EEPROM can be protected.

Figure 7:
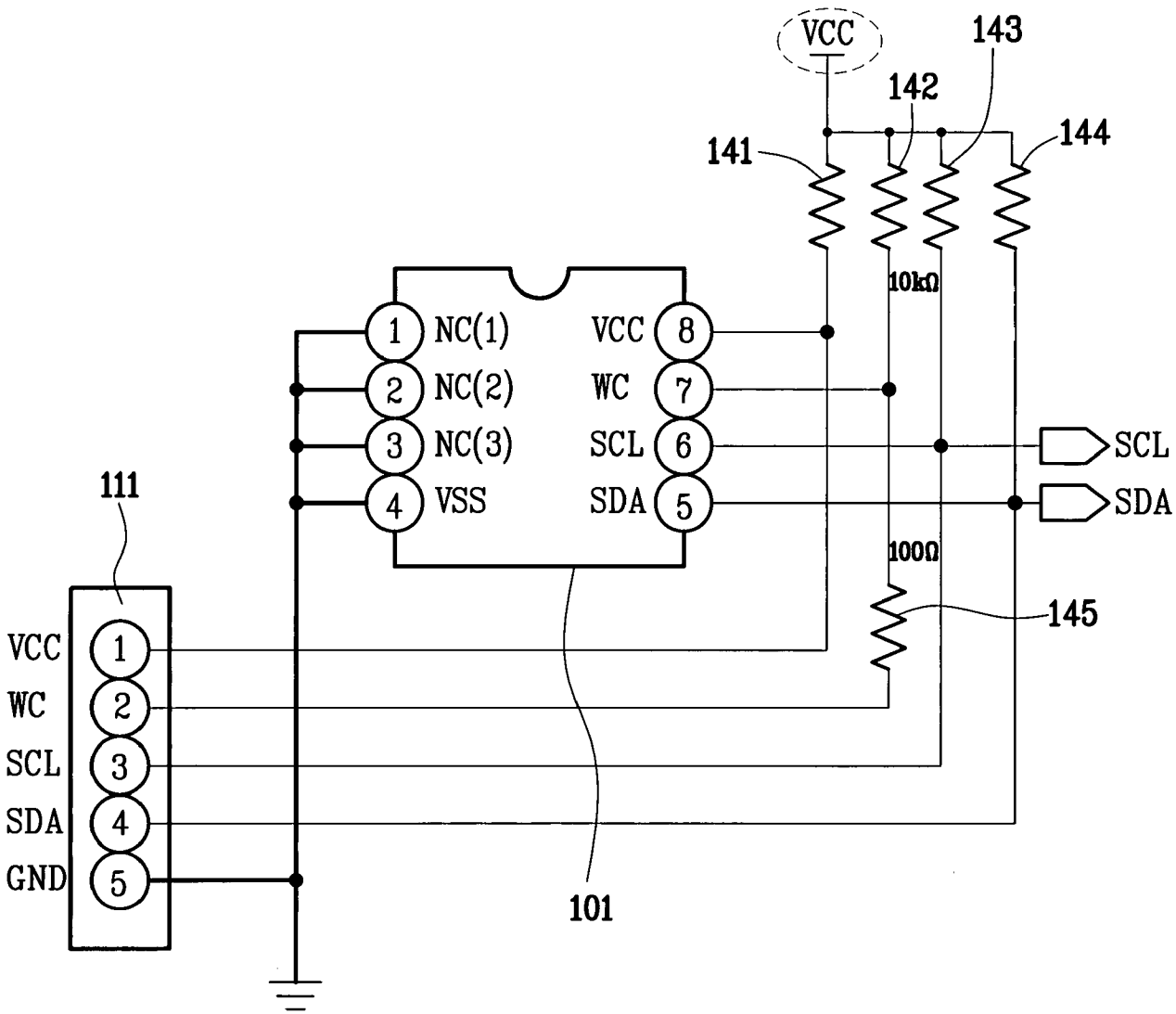
FIG. 7 is a circuit diagram of an external storage unit with peripheral elements where WC is connected to VCC through a resistive ladder.

FIG. 7 is a circuit diagram of an external storage unit, or EEPROM, and peripheral elements of an over-driving circuit or adaptive brightness intensification backlight unit A driving circuit of a liquid crystal display device may include an external storage unit, or EEPROM 101, for providing control data, in a look-up table ("LUT"), necessary to the control of over-driving or adaptive brightness intensification by a timing controller, and a connector 111 for connecting external ROM writing equipment (not shown) with a plurality of terminals of the EEPROM 101 to write the control data into the EEPROM 101. Among the terminals of the EEPROM 101, the fifth terminal and the sixth terminal receive a data signal SDA and a clock signal SCL, respectively. The driving circuit further comprises an internal power supply VCC of a liquid crystal module for applying an internal supply voltage VCC to the EEPROM 101. Among the terminals of the EEPROM 101, the seventh terminal is a write control terminal which is grounded in a write mode and connected to the internal power supply VCC of the liquid crystal module in a liquid crystal module drive mode. The connector 111 has a plurality of terminals including a write terminal (second terminal) which is connected with the write control terminal of the EEPROM 101.

The connector 111 has five terminals including the write terminal (second terminal), differently from the connector with the four terminals described in the previous example. The first terminal of the connector 111 is a supply voltage terminal, the third and fourth terminals thereof are connected with an SCL terminal and SDA terminal of the external ROM writing equipment, respectively, and the fifth terminal thereof is a ground terminal.

A first resistor 141 is connected between the internal power supply VCC of the liquid crystal module and the eighth terminal of the EEPROM 101, which is a supply voltage terminal. A second resistor 142 is connected between the internal power supply VCC of the liquid crystal module and the write control terminal, or the seventh terminal of the EEPROM 101. A third resistor 143 is connected between the internal power supply VCC of the liquid crystal module and the SCL terminal (sixth terminal) of the EEPROM 101, and a fourth resistor 144 is connected between the internal power supply VCC of the liquid crystal module and the SDA terminal (fifth terminal) of the EEPROM 101.

A fifth resistor 145 is connected between the write control terminal of the EEPROM 101 and the write terminal (second terminal) of the connector 111. The fifth resistor 145 has a resistance much lower than that of the second resistor 142 (i.e., second resistor>>fifth resistor). For example, the second resistor 142 may be about 10 KΩ and the fifth resistor 145 may be about 100Ω, so that a low voltage (a voltage close to the ground voltage) can be applied to the write control terminal of the EEPROM 101 when the write terminal (second terminal) is connected with the write control terminal.

This connection between the write control terminal of the EEPROM 101 and the write terminal (second terminal) of the connector 111 means the write mode. The write control terminal is applied with the low voltage to represent a write enable state. On the other hand, in the liquid crystal module drive mode, the write terminal (second terminal) of the connector 111 is opened and the write control terminal (seventh terminal) of the EEPROM 101 is applied with the internal supply voltage VCC (high voltage), so that data written in the EEPROM 101 can be stably protected.

The operation of the EEPROM in the driving circuit of the liquid crystal display device will hereinafter be described under the condition that it is classified into an operation in the write mode and an operation in the liquid crystal module drive mode.

In the write mode, the third terminal of the connector 111 is connected with the SCL terminal of the external ROM writing equipment, and the fourth terminal of the connector 111 is connected with the SDA terminal of the external ROM writing equipment.

The third and fourth terminals of the connector 111 are also connected with the sixth and fifth terminals of the EEPROM 101. As a result, the external ROM writing equipment can communicate with the EEPROM 101 in an I2C protocol manner to write desired data into the EEPROM 101.

At this time, in the write mode, the seventh terminal of the EEPROM 101, which is the write control (WC) terminal, is connected with the internal power supply of the liquid crystal module via the second resistor 142 and with the second terminal of the connector 111 via the fifth resistor 145. As a result, a low signal (a voltage close to the ground voltage) is applied to the write control terminal so that the EEPROM 101 can be maintained in the write enable state.

On the other hand, in the liquid crystal module drive mode, the EEPROM 101 may function as a memory containing a look-up table for the over-driving or adaptive brightness intensification. In this case, the write terminal, or the second terminal of the connector 111, is opened and the write control terminal, or the seventh terminal of the EEPROM 101, is thus connected with the internal power supply VCC of the liquid crystal module via the second resistor 142 so as to be applied with a high signal therefrom. As a result, data (look-up table data) stored in the EEPROM 101 in the write mode can be stably protected.

In the driving circuit of the liquid crystal display device, as stated above, the supply voltage is applied to the write control terminal of the EEPROM in the liquid crystal module drive mode after the write mode is performed. Therefore, the writing of further different data can be prevented so that the data written in the EEPROM can be protected.

Figure 8:
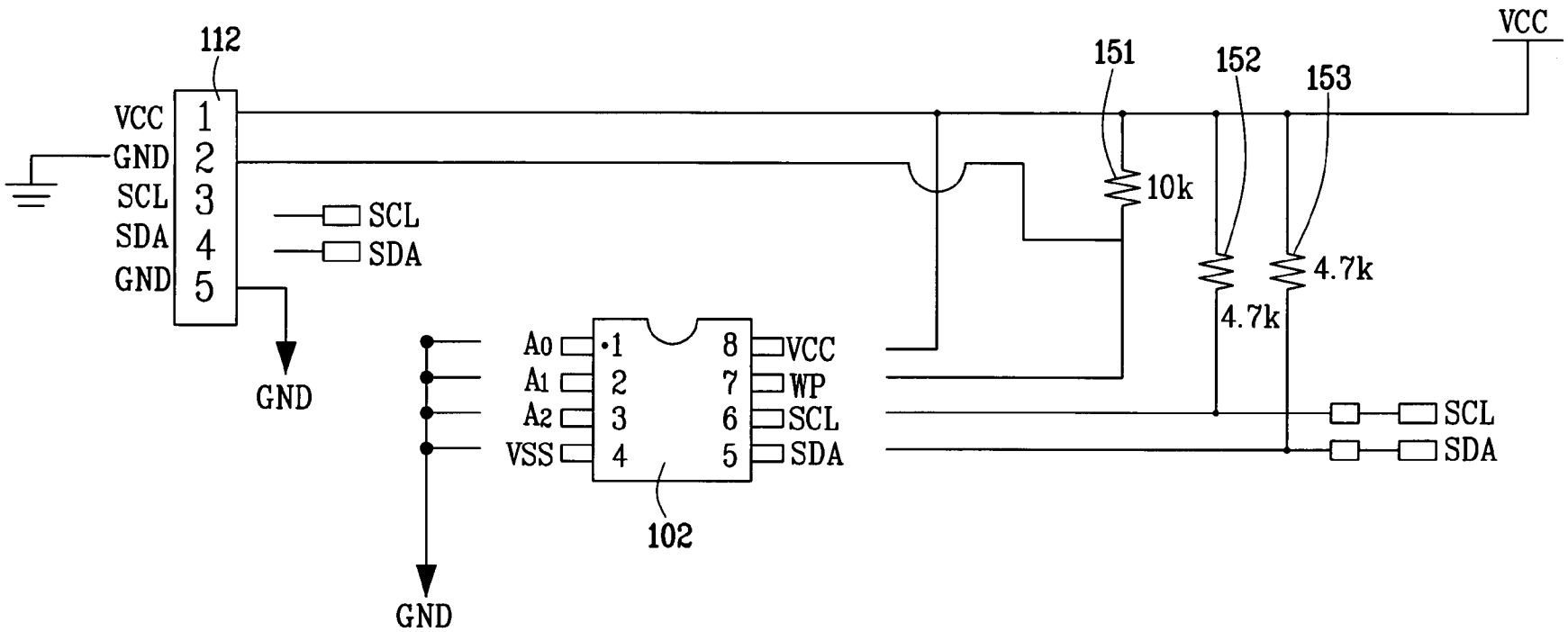
FIG. 8 is a circuit diagram of an external storage unit and peripheral elements where WP is connected to ground.

FIG. 8 is a circuit diagram of an external storage unit, or EEPROM, and peripheral elements of an over-driving circuit or adaptive brightness intensification backlight unit.

In a driving circuit of a liquid crystal display device, the connections between the EEPROM and the peripheral elements may be made in the same manner as those in the previous embodiment, with the exception that the first resistor 141 and fifth resistor 145 in the previous embodiment (see FIG. 7) are omitted, the write control (WC) terminal, or the seventh terminal of the EEPROM, is not connected with the connector and the write terminal (second terminal) of the connector is directly connected with the lower end of a resistor formed between the supply voltage and the write control terminal, as shown in FIG. 8.

The driving circuit of the liquid crystal display device may include an external storage unit, or EEPROM, 102 for providing control data in a look-up table (LUT) that may be necessary for the control of over-driving or adaptive brightness intensification by a timing controller, and a connector 112 for connecting external ROM writing equipment (not shown) with a plurality of terminals of the EEPROM 102 to write the control data into the EEPROM 102. Among the terminals of the EEPROM 102, the fifth terminal and the sixth terminal receive a data signal SDA and a clock signal SCL, respectively. The driving circuit further includes an internal power supply VCC of a liquid crystal module for applying an internal supply voltage VCC to the EEPROM 102. Among the terminals of the EEPROM 102, the seventh terminal is a write control terminal which is grounded in a write mode and connected to the internal power supply VCC of the liquid crystal module in a liquid crystal module drive mode. The connector 112 has a plurality of terminals including a write terminal (second terminal) which is connected with the write control terminal of the EEPROM 102.

The connector 112 has five terminals including the write terminal (second terminal), similarly to the embodiment of FIG. 7. In FIG. 8, the first terminal of the connector 112 is a supply voltage terminal, the third and fourth terminals thereof are connected with an SCL terminal and SDA terminal of the external ROM writing equipment, respectively, and the fifth terminal thereof is a ground terminal.

A first resistor 151 is connected between the internal power supply VCC of the liquid crystal module and the write control terminal, or the seventh terminal of the EEPROM 102. A second resistor 152 is connected between the internal power supply VCC of the liquid crystal module and the SCL terminal (sixth terminal) of the EEPROM 102, and a third resistor 153 is connected between the internal power supply VCC of the liquid crystal module and the SDA terminal (fifth terminal) of the EEPROM 102.

The write terminal, or the second terminal of the connector 112, is grounded in the write mode, and connected between the first resistor 151 and the write control terminal, or the seventh terminal of the EEPROM 102, in the liquid crystal module drive mode so as to be applied with a supply voltage signal (a high signal close to VCC). Thus, the EEPROM can be maintained in the write enable state in the write mode and data written in the EEPROM can be stably maintained and protected in the liquid crystal module drive mode after the write mode is performed.

The operation of the EEPROM in the driving circuit of the liquid crystal display device will hereinafter be described under the condition that it is classified into an operation in the write mode and an operation in the liquid crystal module drive mode.

In the write mode, the third terminal of the connector 112 is connected with the SCL terminal of the external ROM writing equipment, and the fourth terminal of the connector 112 is connected with the SDA terminal of the external ROM writing equipment.

The third and fourth terminals of the connector 112 are also connected with the sixth and fifth terminals of the EEPROM 102. As a result, the external ROM writing equipment can communicate with the EEPROM 102 in an I2C protocol manner to write desired data into the EEPROM 102.

In the liquid crystal module drive mode, the write terminal, or the second terminal of the connector 112, is connected between the first resistor 151 and the write control terminal, or the seventh terminal of the EEPROM 102, so as to be applied with a supply voltage signal (a high signal close to VCC).

In this liquid crystal module drive mode, the EEPROM 102 functions as a memory containing a look-up table for the over-driving or adaptive brightness intensification. In this case, the write terminal, or the second terminal of the connector 112, is connected with the lower end of the first resistor 151 so as to be applied with the supply voltage signal. As a result, data (look-up table data) stored in the EEPROM 102 in the write mode can be stably protected.

In the driving circuit of the liquid crystal display device, as stated above, the supply voltage is applied to the write control terminal of the EEPROM in the liquid crystal module drive mode after the write mode is performed. Therefore, the writing of further different data can be prevented so that the data written in the EEPROM can be protected.

Figure 9:
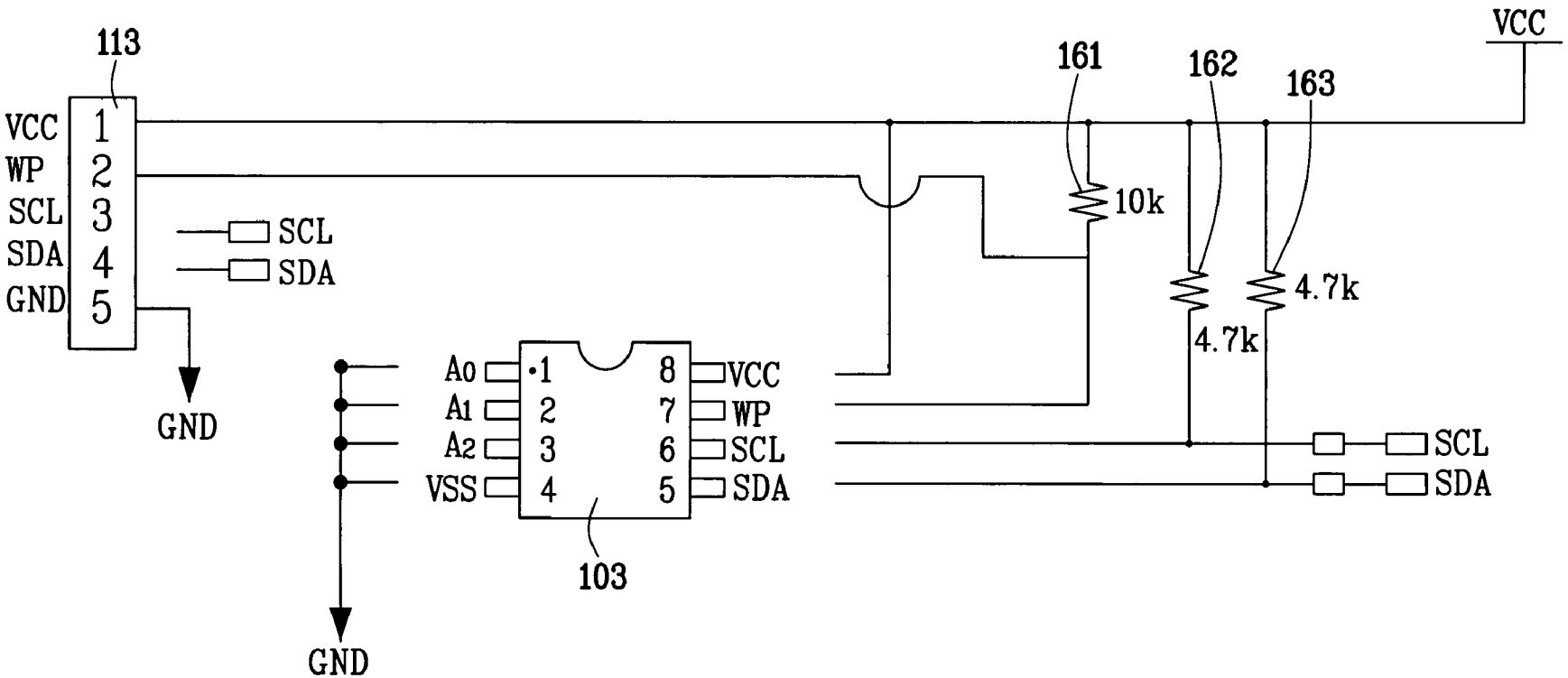
FIG. 9 is a circuit diagram of an external storage unit and peripheral elements where WP is connected to VCC and an external connector.

FIG. 9 is a circuit diagram of another embodiment of an external storage unit, or EEPROM, and peripheral elements of an over-driving circuit or adaptive brightness intensification backlight unit.

In a driving circuit of a liquid crystal display device, the connections between the EEPROM and the peripheral elements are made in the same manner as those in the embodiment of FIG. 6, with the exception that the write terminal, or the second terminal of the connector, is connected with the external ROM writing equipment in the write mode so as to be operated under control of the external ROM writing equipment.

The driving circuit of the liquid crystal display device may include an external storage unit, or EEPROM, 103 for providing control data (in a look-up table (LUT)) necessary for the control of over-driving or adaptive brightness intensification by a timing controller, and a connector 113 for connecting external ROM writing equipment (not shown) with a plurality of terminals of the EEPROM 103 to write the control data into the EEPROM 103. Among the terminals of the EEPROM 103, the fifth terminal and the sixth terminal receive a data signal SDA and a clock signal SCL, respectively. The driving circuit further comprises an internal power supply VCC of a liquid crystal module for applying an internal supply voltage VCC to the EEPROM 103. Among the terminals of the EEPROM 103, the seventh terminal is a write control terminal which is grounded in a write mode and connected to the internal power supply VCC of the liquid crystal module in a liquid crystal module drive mode. The connector 113 has a plurality of terminals including a write terminal (second terminal) which is connected with the write control terminal of the EEPROM 103.

The connector 113 has five terminals including the write terminal (second terminal), similarly to the embodiment of FIG. 8. The first terminal of the connector 113 is a supply voltage terminal, the third and fourth terminals thereof are connected with an SCL terminal and SDA terminal of the external ROM writing equipment, respectively, and the fifth terminal thereof is a ground terminal.

A first resistor 161 is connected between the internal power supply VCC of the liquid crystal module and the write control terminal, or the seventh terminal of the EEPROM 103. A second resistor 162 is connected between the internal power supply VCC of the liquid crystal module and the SCL terminal (sixth terminal) of the EEPROM 103, and a third resistor 163 is connected between the internal power supply VCC of the liquid crystal module and the SDA terminal (fifth terminal) of the EEPROM 103.

In write mode, the write terminal, or the second terminal of the connector 113, is connected with a specific terminal of the external ROM writing equipment so as to be operated in response to a command from the ROM writing equipment. In the liquid crystal module drive mode, the second terminal of the connector 113 is connected between the first resistor 161 and the write control terminal, or the seventh terminal of the EEPROM 103, so as to be applied with a supply voltage signal (a high signal close to VCC). Thus, the EEPROM can be maintained in the write enable state in the write mode and data written in the EEPROM can be stably maintained and protected in the liquid crystal module drive mode after the write mode is performed.

In the driving circuit of the liquid crystal display device, in the liquid crystal module drive mode, the write terminal of the connector 113 is connected with the lower end of the first resistor 161 so as to be applied with the internal supply voltage. As a result, data written in the EEPROM 103 can be protected.

In the write mode, the write terminal of the connector 113 is connected with the ROM writing equipment so that the writing operation can be stably performed under no influence of leakage current.

Figure 10:
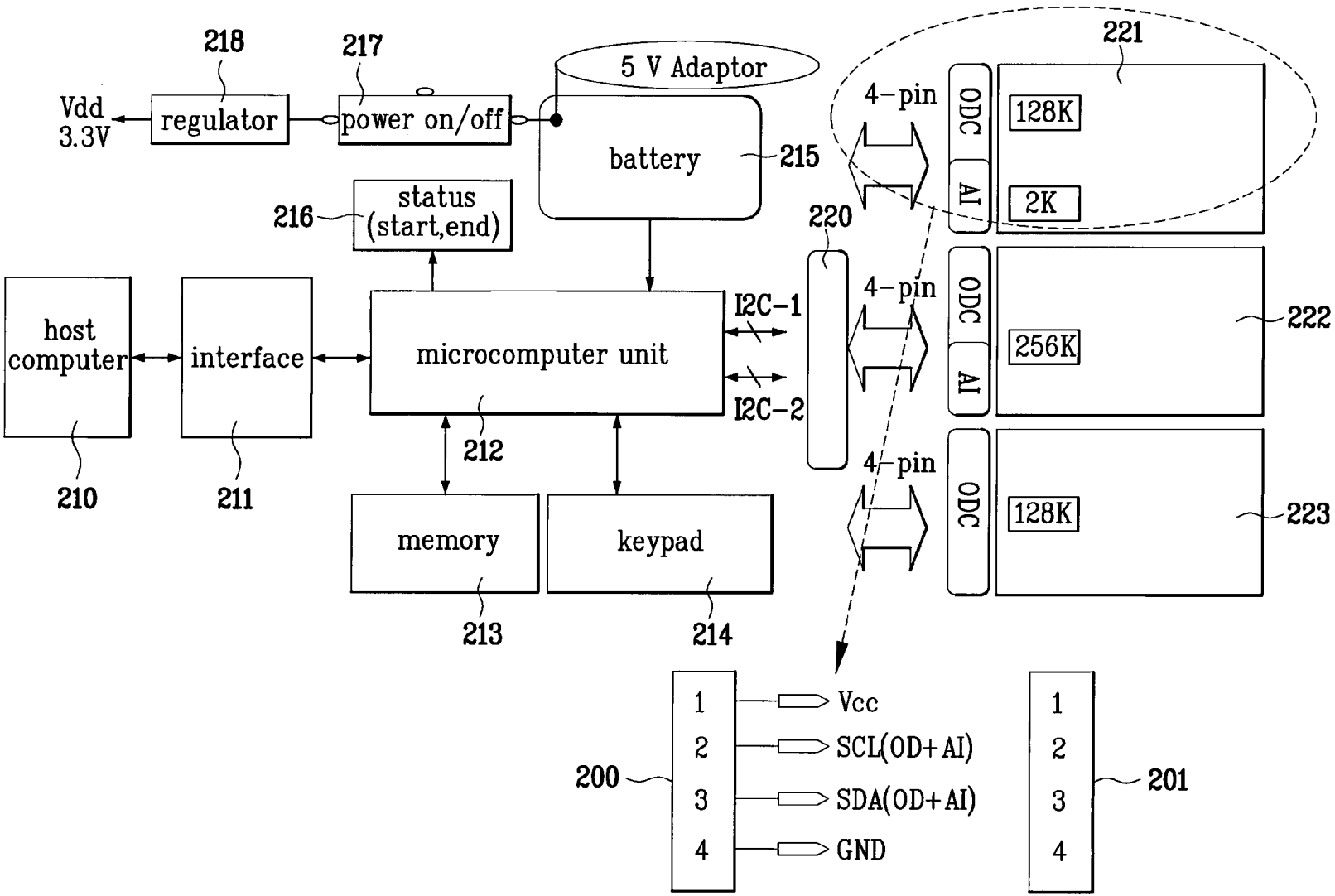
FIG. 10 is a block diagram showing connections of an EEPROM in a write mode.

FIG. 10 is a block diagram showing connections of an EEPROM in a write mode. The writing of the EEPROM may be performed through I2C protocol communication using a connector 200.

At this time, external ROM writing equipment is connected with the connector 200. The ROM writing equipment may include a microcomputer unit 212 for managing a series of control operations required for the writing of the EEPROM 201 or 220, a memory 213 for sending and receiving data to/from the microcomputer unit 212, a keypad 214 for applying a desired command to the microcomputer unit 212 in response to the user's operation, a battery 215 for applying a drive voltage to the microcomputer unit 212, a power on/off unit 217 for applying a power on/off signal to the battery 215, and a regulator 218 for regulating a supply voltage from the battery. The microcomputer unit 212 may be connected to an external host computer 210 via an interface 211.

The microcomputer unit 212 also may control a start time and end time of signal application to the EEPROM 201 or 220 through a status 216 indicative of a start or end.

The EEPROM 201 or 220 may be connected, through predetermined pins, with a master in a timing controller 221, 222 or 223 in a liquid crystal display module. The master is an over-drive circuit that supplies an over gray scale voltage to data lines of a liquid crystal panel, and/or an AI circuit that adjusts backlight brightness according to a luminance variation of every frame of inputted video data.

The EEPROM acts as a slave that stores a look-up table (LUT) for over-driving or adaptive brightness intensification. The external ROM writing equipment is separated from the EEPROM 220 after performing the writing of the EEPROM.

As apparent from the above description, the driving circuit of the liquid crystal display device according to the embodiments has effects as follows.

Firstly, the write control pin of the EEPROM is grounded in the write mode so that the EEPROM can be maintained in the write enable state, and is connected with the internal supply voltage of the liquid crystal module in the liquid crystal module drive mode so that the data stored in the EEPROM can be protected. Therefore, the writing of further different data in the EEPROM can be prevented in the liquid crystal module drive mode, thereby making it possible to prevent a poor display state from occurring when the over-driving or adaptive brightness intensification is carried out on the basis of the look-up table in the EEPROM.

Secondly, the data written in the EEPROM can be protected, thereby reducing expenses resulting from processes conducted at the user's request caused by data loss.

Thirdly, the present invention is applicable to all models using the EEPROM as the look-up table.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A circuit for driving a liquid crystal display device having a write mode and a liquid crystal module drive mode, comprising:

a master that over-drives and provides adaptive brightness intensification;

a slave that provides desired control data to the master;

a writing circuit that controls writing of control data to the slave such that the write mode does not occur during the liquid crystal module drive mode;

a connector that connects the writing circuit with a plurality of terminals of the slave that write the control data into the slave; and an internal power supply of a liquid crystal module that applies an internal supply voltage to the slave during the liquid crystal module drive mode, wherein the writing circuit applies about a ground potential to a write control terminal on the slave during a write mode and about an internal power supply voltage of the liquid crystal module is applied to the write control terminal during a liquid crystal module drive mode and wherein the connector had a write terminal connected with the write control terminal.

2. The circuit as set forth in claim 1, wherein the writing circuit is a resistive network.

3. The circuit as set forth in claim 1, wherein the write terminal is connected to the writing circuit in the write mode and to the internal power supply of the liquid crystal module in the liquid crystal module drive mode.

4. The circuit as set forth in claim 1, wherein the master is an over-driving circuit that supplies an over gray scale voltage to data lines of the liquid crystal display device.

5. The circuit as set forth in claim 1, wherein the master is an adaptive brightness intensifier circuit that adjusts backlight brightness according to a luminance variation of every frame of inputted video data.

6. A circuit for driving a liquid crystal display device, comprising:

a master that over-drives and provides adaptive brightness intensification;

a slave that provides desired control data to the master;

a connector that connects external writing equipment with a plurality of terminals of the slave that writes the control data into the slave; and an internal power supply of a liquid crystal module that applies an internal supply voltage to the slave, wherein the plurality of terminals of the slave include a write control terminal that is at about ground potential in a write mode, and at about the internal power supply potential in the liquid crystal module drive mode, and the write mode does not occur during the liquid crystal module drive mode and wherein the connector has a write terminal connected with the write control terminal.

7. The circuit as set forth in claim 6, wherein the write control terminal is opened and internally pulled down to a ground potential in the slave during the write mode.

8. The circuit as set forth in claim 7, further comprising a diode connected between the internal power supply of the liquid crystal module and a supply voltage terminal among the plurality of terminals of the slave.

9. The circuit as set forth in claim 6, further comprising:

a first resistor connected between the internal power supply of the liquid crystal module and the write control terminal; and a second resistor connected between the write control terminal and the write terminal, wherein the first resistor has a resistance much higher than that of the second resistor.

10. The circuit as set forth in claim 6, wherein the write terminal is opened in the liquid crystal module drive mode.

11. The circuit as set forth in claim 6, wherein the write terminal is grounded in the write mode, and connected with the internal power supply of the liquid crystal module in the liquid crystal module drive mode.

12. The circuit as set forth in claim 6, wherein the write terminal is connected with the external writing equipment in the write mode, and with the internal power supply of the liquid crystal module together with the write control terminal in the liquid crystal module drive mode.

13. The circuit as set forth in claim 6, wherein the master is an over-driving circuit that supplies an over gray scale voltage to data lines of a liquid crystal panel.

14. The circuit as set forth in claim 6, wherein the master is an adaptive brightness intensifier circuit that adjusts backlight brightness according to a luminance variation of every frame of inputted video data.

15. The circuit as set forth in claim 6, wherein the slave is an electrically erasable programmable read only memory (EEPROM) that stores a look-up table for the over-driving.

16. The circuit as set forth in claim 6, wherein the slave is an EEPROM that stores a look-up table for the adaptive brightness intensification.

* * * * *

UNITED STATES PATENT AND TRADEMARK OFFICE

CERTIFICATE OF CORRECTION

PATENT NO. : 7,586,475 B2
APPLICATION NO. : 11/172600
DATED : September 8, 2009
INVENTOR(S) : Lee et al.

It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 645 days.

Delete the phrase "by 645 days" and insert -- by 908 days --

Signed and Sealed this

Eleventh Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,586,475 B2
APPLICATION NO. : 11/172600
DATED : September 8, 2009
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 908 days.

Signed and Sealed this
Seventeenth Day of May, 2011

David J. Kappos

David J. Kappos
*Director of the United States Patent and Trademark Office*